United States Patent [19]

Grilliot et al.

[11] Patent Number: 4,790,040

[45] Date of Patent: Dec. 13, 1988

[54] TRANSPORT CONTAINER FOR VICTIM CONTAMINATED BY HAZARDOUS MATERIAL

[76] Inventors: William L. Grilliot; Mary I. Grilliot, both of 1986 Home Ave., Dayton, Ohio 45417

[21] Appl. No.: 34,726

[22] Filed: Apr. 6, 1987

[51] Int. Cl.[4] ..... A47G 9/08; A61G 1/00

[52] U.S. Cl. ..... 5/413; 2/2; 2/69.5; 5/82 R

[58] Field of Search ..... 5/413, 82 R; 2/69.5, 2/84, 69, 2

[56] References Cited

U.S. PATENT DOCUMENTS

| | | | |
|---|---|---|---|
| 1,315,294 | 9/1919 | Fink et al. | 2/69.5 |
| 1,919,154 | 7/1933 | Astrove | 5/413 |
| 1,940,224 | 12/1933 | Munro | 5/413 |
| 1,952,465 | 3/1934 | Rycroft | 5/413 |
| 2,036,175 | 3/1936 | Hollander | 2/69.5 |
| 2,242,130 | 5/1941 | Hutchison | 2/69.5 |
| 2,675,552 | 4/1954 | Jackson | 5/413 |
| 2,931,043 | 4/1960 | Achner | 2/69.5 |
| 4,485,490 | 12/1984 | Akers et al. | 2/2 |
| 4,579,753 | 4/1986 | Gjendemsco | 5/43 |

FOREIGN PATENT DOCUMENTS

| | | | |
|---|---|---|---|
| 2485905 | 1/1982 | France | 5/413 |

OTHER PUBLICATIONS

Morning Pride Manufacturing, Apr. 1986 Catalog-Reprinted and Updated 1986, Morning Pride's Haz-Mat Cocoon Suits, p. 26.

*Primary Examiner*—Alexander Grosz

*Attorney, Agent, or Firm*—Jacox & Meckstroth

[57] ABSTRACT

A victim transport container for a victim contaminated by hazardous material. The victim transport container comprises a body section and a neck band and a hood section. The body section has a plurality of panels joined together to form a generally rectangular body. The container has a front panel which is openable and closeable by means of an attachment member. The attachment member is sealed after a victim is placed within the body section.

6 Claims, 2 Drawing Sheets

50
52
58
28
34s
40
5
38
42
41
16
16a
16b
22
34
12
30
18
60
20
22e
D
W 50
52
58
40
28
27
19
42
34s
21
20
22
24
12
16
16a
16b
6
34
22e
26
18
30
60

TRANSPORT CONTAINER FOR VICTIM CONTAMINATED BY HAZARDOUS MATERIAL

BACKGROUND OF THE INVENTION

Occasions arise in which a person is involved in an accident in which hazardous contaminating materials cover the person. In the past, the person is placed in an ambulance or some other vehicle and rushed to a hospital or other emergency care center.

Of course, as the victim of the accident is placed into an ambulance and transported to a hospital or emergency care center, the people who come into contact with the victim, and the ambulance and portions of the hospital are contaminated by the hazardous contaminating materials which are carried by the victim as a result of the accident.

In the past, attempts have been made to protect an ambulance by temporarily covering the walls of an ambulance in which a victim of hazardous materials is transported. This was done in an attempt to protect the other portions of the ambulance. Also, in the past, walls of an emergency room have been temporarily covered when a victim of hazardous material has been treated in the room. This was done in an attempt to protect the other parts of the emergency care center from the hazardous materials. However, such coverings have not protected the people involved in caring for the victims, and the coverings have not been effective or practical.

An object of this invention is to provide a container into which a victim of hazardous contaminating materials is placed, so that the victim can be transported to a hospital or emergency care center without causing contamination of other people and objects.

Another object of this invention is to provide such a container which is capable of containing a large person or a small person and which is capable of containing, if necessary, bulky clothes and boots of the victim.

Another object of this invention is to provide such a container which encloses the entire victim, except perhaps, a portion of the victim's face.

Another object of this invention is to provide such a container into which an accident victim can be quickly placed and within which the victim is sealed against contamination of the environment.

Another object of this invention to provide such a container which permits limited arm and leg movement of the victim while the victim is within the container.

Another object of this invention is to provide such a container which is disposable or easily cleaned.

Another object of this invention is to provide such a container which can be produced at relatively low costs.

Another object of this invention is to provide a container which can serve as a body bag for a dead body in the event the victim of hazardous materials should die before receiving emergency care or while receiving emergency care.

Another object of this invention is to provide a method of transporting a victim of hazardous material, while protecting other people and areas involved in transporting and caring for the victim.

Other objects and advantages of this invention reside in the construction of parts, the combination thereof, the method of production and the mode of use, as will become more apparent from the following description.

SUMMARY OF THE INVENTION

A container of this invention comprises an elongate bag-like member of flexible material. The material is any suitable material which is resistant and impervious to liquids and gases and to hazardous chemicals or the like. The material, for example, may be "Saran" or "Saran"-coated "Tyvek" material.

The container has an elongate body section, which includes a back panel, a front panel, a bottom panel and side panels. Preferably, the side panels are integral with the back panel. The front panel is provided with an elongate opening which is closed by a slide fastener device. The opening and the slide fastener are sealed by a sealable flap.

A neck band and a hood section are attached to the upper part of the body section. A draw string within the neck band serves as means to tighten the neck band, and a draw string within the hood section serves as means for tightening the hood section.

Thus, this invention provides a new method of transporting a victim of hazardous materials. Instead of attempting to restrict the area within which the victim is transported and treated, the victim is contained in a container which prevents further contamination of the area and personnel.

DETAILED DESCRIPTION OF THE PREFERRED EMBODIMENT

Figures 1, 3, 4, 5, 6, 7:
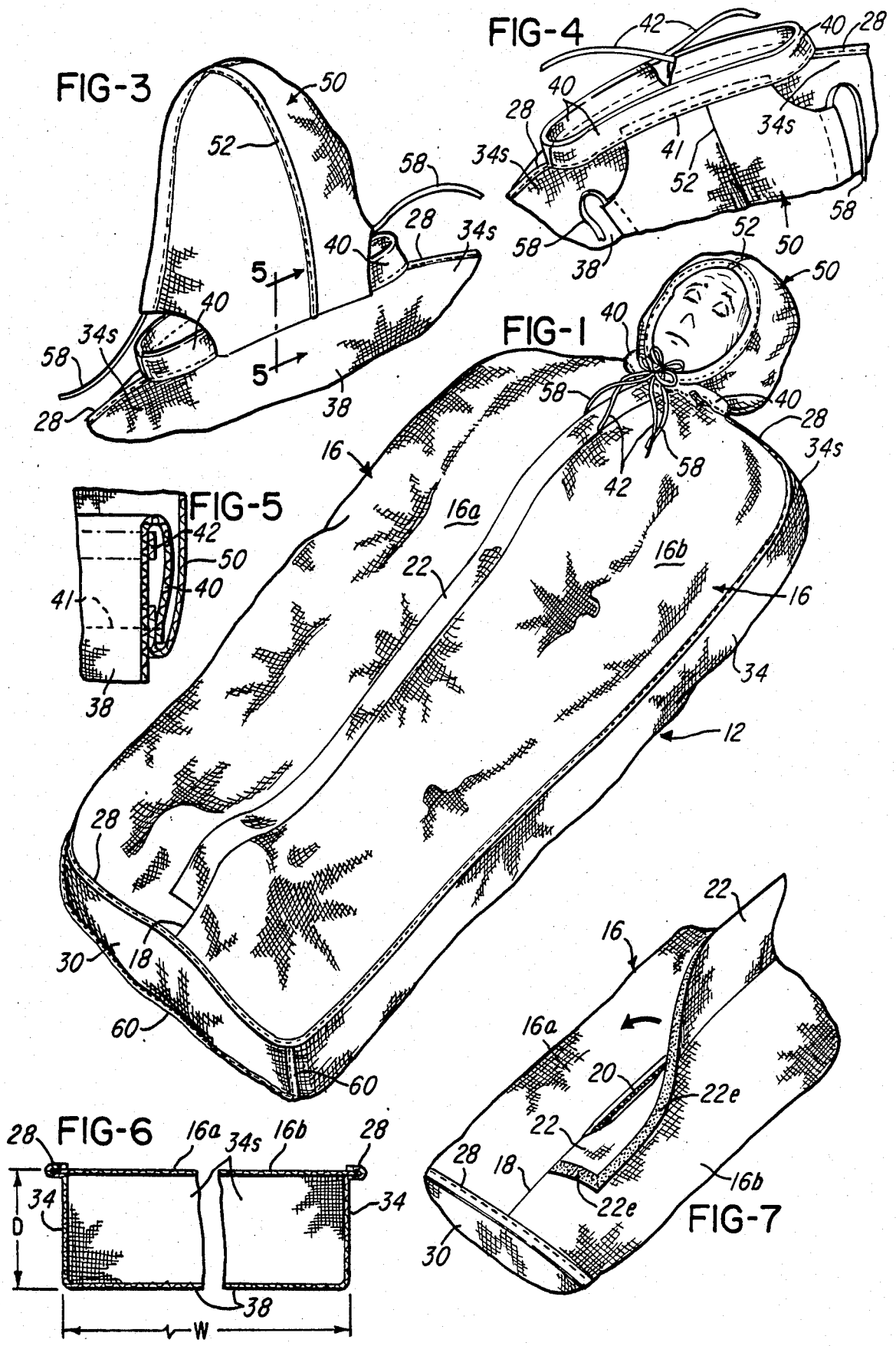
FIG. 1 is a perspective view, illustrating a victim transport container of this invention, with a victim within the container.
FIG. 3 is an enlarged fragmentary perspective back view showing the hood section of the container, with the hood section in an upper position and showing a part of the neck band.
FIG. 4 is a fragmentary perspective back view, similar to FIG. 3, drawn on substantially the same scale as FIG. 3, and showing the hood section in a lower position and showing the neck band.
FIG. 5 is an enlarged fragmentary sectional view taken substantially on line 5—5 of FIG. 3.
FIG. 6 is an enlarged fragmentary sectional view, with parts broken away and shown in section, taken substantially ne 6—6 of FIG. 2.
FIG. 7 is an enlarged fragmentary perspective view illustrating the manner in which the flap portion of the front panel is folded over the slide fastener and the joint closed by the slide fastener.

A transport container of this invention comprises an elongate body section 12 which includes an elongate front panel 16 which has a portion **16*a* and a portion 16*b*. A short seam 18 at the lower part of the panel 16 joins the portion 16*a* and the portion 16*b*. A slide fastener 20 also joins the portion 16*a* and the portion 16*b* as the slide fastener 20 extends from the seam 18 to a position adjacent the upper part of the panel 16. The slide fastener 20 has a connection tab 19 to which is attached a pull cord 21**.

Figures 2, 8:
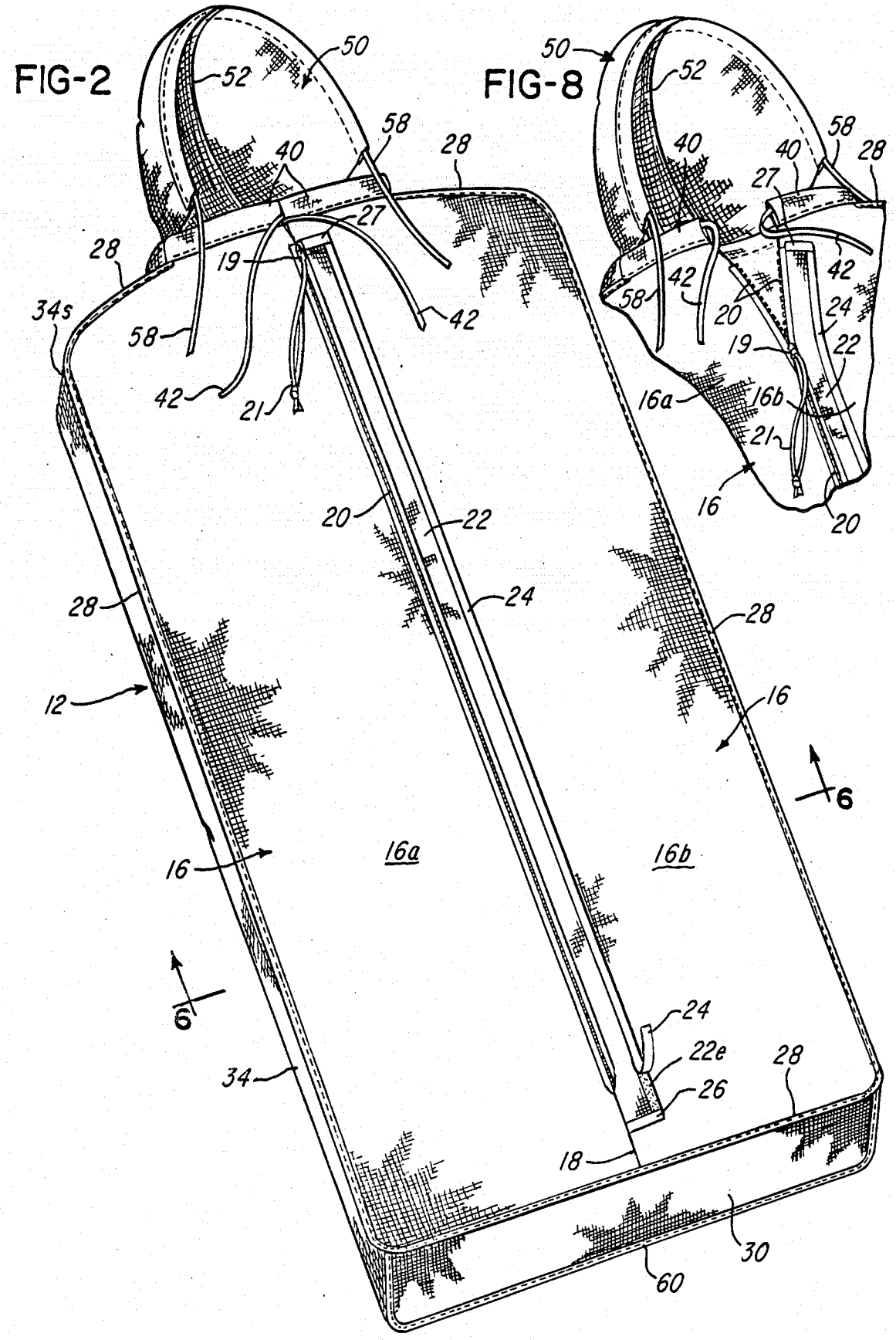
FIG. 2 is a perspective view, drawn on a slightly larger scale than FIG. 1, showing the victim transport container without a victim therein.
FIG. 8 is a fragmentary front perspective view, drawn on substantially the same scale as FIG. 2 and showing a portion of the slide fastener in separated condition and showing the upper part of the body section partly separated and showing the hood section and neck band.

A flap 22 is attached to the seam 18 and to the portion 16*b* adjacent the slide fastener 20 and along the length of the slide fastener 20. The flap 22 has an edge part 22*e* which carries suitable attachment means, such as, for example, adhesive material. Herein the edge part 22*e* is shown with adhesive material applied thereto and covered by a removable strip 24, as illustrated in FIG. 2. The flap 22 also has a bottom edge strip 26 and an upper edge strip 27, which are substantially normal to the seam 18.

Attached to the lower par of the front panel 16 by means of a seam 28 is a bottom panel 30, which is shown as being substantially normal to the front panel 16.

Attached to the front panel 16 along the sides thereof are side panels 34. The sea 28 extends along the sides of the front panel 16 and attaches the side panels 34 to the front panel 16. The side panels 34 extend upwardly and are attached to the upper part of the front panel 16, to form shoulder portions 34*s*.

Integral with the side panels 34 is a back panel 38, which has substantially the same area and configuration as the front panel 16.

Attached to the shoulder portions 34*s* and to the upper part of the front panel 16 is a neck band 40. The neck band 40 is shown as being an extension of the back panel 38, as an extension part of the back panel is folded and stitched by a stitch line 41 in FIG. 5. A draw string 42 extends through the neck band 40 and extends from the neck band 40.

The seam 28 extends substantially around the periphery of the front panel 16 and attaches the side panel 34 and the shoulder portions 34*s* to the front panel 16.

Attached to the neck band 40, as best shown in FIG. 5, is a hood section 50. The hood section 50 is shown in FIG. 3 as having a seam 52 at the central part thereof. If desired, the hood section 50 may be integral with the back panel 38. Extending through the hood section 50 is a draw string 58, which also extends from the hood section 50.

The bottom panel 30 is shown attached to the front panel 16 and back panel 38 and to the side panels 34 by means of seams 60, which are substantially normal to the front panel 16 and the back panel 38. However, if desired, the bottom panel 30 may be integral with the side panels 34 and the back panel 38.

If a person becomes a victim of hazardous material and must be rushed to a hospital or to an emergency care center, the front panel 16 is separated into its two portions 16*a* and 16*b* by moving the connection tab 19 of the slide fastener 20 to a position adjacent the seam 18. In this position of the connection tab 19 the front panel 16 has an opening therein through which the victim can be placed into the body section 12. Then the tab 19 of the slide fastener 20 is slidably moved to the upper part of the panel 16. Thus, the portions 16*a* and 16*b* are joined together by the slide fastener 20. Then the cover strip 24 is removed from the edge portion 22*e* of the flap 22. Then the flap 22 is folded over as illustrated in FIG. 7 and laid upon the portion 16*a* of the front panel 16, as shown in FIG. 1. Thus, the slide fastener 20 is covered and the joint between the portions 16*a* and 16*b* is sealed by the flap 22.

Then the neck band 40 is tightened around the neck of the victim, by tension on the draw string 42. The draw string 42 is then tied, as illustrated in FIG. 1. Then the hood section 50 is placed upon the victim's head and the draw string 58 is tightened around the victim's neck and tied, as illustrated in FIG. 1.

Thus, the victim is secure within the container and only the victim's face is exposed. The victim can then be transported to a hospital or emergency care center without contamination of the transport vehicle and without contamination of other areas through which the victim is moved.

The body section 12 is sufficiently large in capacity to permit a victim and the clothing upon the victim to be positioned within the body section 12. The body section 12 is also sufficiently large to permit movement of the victim's arms and legs during transport of the victim. The body section 12 is also sufficiently large to permit the victim's contaminated tools or other contaminated items to be placed within the body section 12 with the victim. Preferably, but not necessarily, the elongate body section 12 has a width dimension "W" which is at least three (3) feet, and a depth dimension "D" which is at least five and one-half ($5\frac{1}{2}$) inches, as illustrated in FIG. 6. Also, preferably, but not necessarily, the body section 12 has a length of at least six and one-half ($6\frac{1}{2}$) feet.

After the victim is moved to an emergency care area, the victim is removed from the transport container and the transport container may be disposed of or cleaned, as desired.

If the victim of hazardous material should die before being placed in a container of this invention the victim is placed within the container, and the container is closed and sealed by means of the flap. The container is sufficiently large so that the neck band can be closed above the head of the victim and the container is thus completely closed without the use of the hood.

Although the preferred embodiment of the victim transport container of this invention has been described, it will be understood that within the purview of this invention various changes may be made in the form, details, proportion and arrangement of parts, the combination thereof, and the mode of construction, which generally stated consist in a victim transport container within the scope of the appended claims.

The invention having thus been described, the following is claimed:

1. A victim transport container for a person who is a victim contaminated by hazardous material or the like comprising:

a front panel which includes two portions, a slide fastener attached to the two portions and forming a joint for joining and separating the two portions, sealing means extending along the length of the slide fastener to cover the slide fastener and the joint formed thereby, a back panel, a pair of side panels, means attaching the side panels to the back panel and to the front panel, a neck band attached to at least one of the panels, and a hood section attached to at least one of the panels, the neck band being adapted to encompass the neck of a victim, the hood section being adapted to cover a major portion of the head of the victim with the face of the victim uncovered, the panels being of a liquid and gas impermeable material which is also impervious and resistant to hazardous materials, means for securing the neck band around the neck of the victim and means for securing the hood section upon the head of the victim, the neck band being integral with the back panel and comprises a folded extension portion of the back panel, the container adapted to cover the body of a victim, with only the face portion of the victim being exposed.

2. A victim transport container for a person who is a victim contaminated by hazardous material or the like comprising:

a front panel which includes two portions, fastener means releasably attaching the two portions together, a back panel, means attaching the front panel to the back panel, a neck band attached to at least one of the panels, a hood section attached to at least one of the panels, the neck band being adapted to encompass the neck of a victim, the hood section being adapted to cover a major portion of the head of the victim with the face of the victim uncovered, the panels being of a liquid and gas impermeable material which is also impervious and resistant to hazardous materials, means for securing the neck band around the neck of the victim and means for securing the hood section upon the head of the victim, the neck band being integral with the back panel and comprises an extension portion of the back panel, the container adapted to cover the body of a victim, with only the face portion of the victim being exposed.

3. The victim transport container of claim 2 which includes releasable seal means covering the fastener means for sealing the fastener means when a victim is within the transport container.

4. The victim transport container of claim 2 in which the means attaching the front panel to the back panel includes at least one side panel.

5. The victim transport container of claim 2 in which the means attaching the front panel to the back panel includes a side panel and a bottom panel.

6. A victim transport container for a person who is a victim contaminated by hazardous material or the like comprising:

a front panel, a back panel, means releasably attaching the front panel to the back panel, a neck band attached to the back panel, a hood section attached to at least one of the panels, the neck band being adapted to encompass the neck of a victim, the hood section being adapted to cover a major portion of the head of the victim with the face of the victim uncovered, the panels being of a liquid and gas impermeable material which is also impervious and resistant to hazardous materials, means for securing the neck band around the neck of the victim and means for securing the hood section upon the head of the victim, the neck band being integral with the back panel and comprising an extension portion of the back panel, the container adapted to cover the body of a victim, with only the face portion of the victim being exposed.

* * * * *